US012053098B2

(12) United States Patent
Tsern et al.

(10) Patent No.: US 12,053,098 B2
(45) Date of Patent: Aug. 6, 2024

(54) SLEEP PLATFORM PNEUMATICS MANAGEMENT SYSTEM

(71) Applicant: Bryte, Inc., Los Altos, CA (US)

(72) Inventors: Ely Tsern, Los Altos, CA (US); John Tompane, Los Altos, CA (US)

(73) Assignee: Bryte, Inc., Los Altos, CA (US)

( * ) Notice: Subject to any disclaimer, the term of this patent is extended or adjusted under 35 U.S.C. 154(b) by 189 days.

(21) Appl. No.: 17/433,186

(22) PCT Filed: Feb. 21, 2020

(86) PCT No.: PCT/US2020/019323
§ 371 (c)(1),
(2) Date: Aug. 23, 2021

(87) PCT Pub. No.: WO2020/172600
PCT Pub. Date: Aug. 27, 2020

(65) Prior Publication Data

US 2022/0133054 A1 May 5, 2022

Related U.S. Application Data

(60) Provisional application No. 62/809,192, filed on Feb. 22, 2019.

(51) Int. Cl.
*A47C 27/10* (2006.01)
*A47C 27/08* (2006.01)

(52) U.S. Cl.
CPC ..... *A47C 27/10* (2013.01); *A47C 27/082* (2013.01); *A47C 27/083* (2013.01)

(58) Field of Classification Search
CPC ..... A47C 27/08; A47C 27/081; A47C 27/082; A47C 27/083; A47C 27/084; A47C 27/10
See application file for complete search history.

(56) References Cited

U.S. PATENT DOCUMENTS

2002/0078500 A1 6/2002 Davis
2008/0109962 A1 5/2008 Wang et al.
2010/0064443 A1 3/2010 Lee
(Continued)

FOREIGN PATENT DOCUMENTS

CN 101969911 A 2/2011
CN 102652701 A 9/2012
(Continued)

OTHER PUBLICATIONS

Extended European Search Report dated Oct. 13, 2022 issued in corresponding EP Appln. No. 20759876.4.
(Continued)

*Primary Examiner* — Justin C Mikowski
*Assistant Examiner* — George Sun
(74) *Attorney, Agent, or Firm* — KPPB LLP

(57) ABSTRACT

A bed may provide pneumatic effects. An array of pumps may be used in providing the pneumatic effects. In some embodiments less than all of the pumps may be operated to provide some of the pneumatic effects, and in some such embodiments no individual pump may be able to provide others of the pneumatic effects, and in some or other such embodiments all of the pumps may be required to provide at least one of the pneumatic effects.

5 Claims, 11 Drawing Sheets

(56) References Cited

U.S. PATENT DOCUMENTS

| | | | | |
|---|---|---|---|---|
| 2010/0089411 | A1* | 4/2010 | Porter, III | A61G 7/05769 128/889 |
| 2011/0289691 | A1 | 12/2011 | Lafleche et al. | |
| 2011/0301516 | A1* | 12/2011 | Lafleche | A47C 27/10 5/713 |
| 2013/0042413 | A1 | 2/2013 | Cao | |
| 2015/0082547 | A1* | 3/2015 | Boyd | G05D 16/2006 5/706 |
| 2015/0128341 | A1* | 5/2015 | Kuiper | A61G 7/001 5/83.1 |
| 2015/0135444 | A1* | 5/2015 | Spahn | A61G 7/05769 5/655.3 |
| 2017/0000685 | A1 | 1/2017 | Rohr et al. | |
| 2017/0035360 | A1 | 2/2017 | Monson et al. | |
| 2018/0116419 | A1 | 5/2018 | Shakal | |
| 2018/0119686 | A1 | 5/2018 | Shakal | |
| 2018/0140107 | A1 | 5/2018 | Driscoll et al. | |
| 2018/0153310 | A1* | 6/2018 | Thomas | A47C 27/064 |
| 2018/0220971 | A1* | 8/2018 | Benson | A61B 5/01 |

FOREIGN PATENT DOCUMENTS

| | | | |
|---|---|---|---|
| TW | 200924673 | A | 6/2009 |
| WO | 2005009176 | A1 | 2/2005 |

OTHER PUBLICATIONS

Chinese Office Action dated Oct. 17, 2022 issued in corresponding CN Appln. No. 202080023043.5.

International Search Report on related PCT application (PCT/US2020/019323) from International Searching Authority (Korean Intellectual Property Office) dated Jun. 23, 2020.

Written Opinion on related PCT application (PCT/US2020/019323) from International Searching Authority (Korean Intellectual Property Office) dated Jun. 23, 2020.

* cited by examiner

SLEEP PLATFORM PNEUMATICS MANAGEMENT SYSTEM

CROSS REFERENCE TO RELATED APPLICATION

This application is a national phase filing, under 35 U.S.C. § 371(c), of International Application No. PCT/US2020/019323, filed on Feb. 21, 2020, which claims the benefit of the filing date of U.S. Provisional Patent Application No. 62/809,192, filed on Feb. 22, 2019, the disclosures of which are incorporated by reference in their entireties herein.

BACKGROUND OF THE INVENTION

The present invention relates generally to beds with pneumatic features, and more particularly to a bed with a plurality of pumps for use in providing one or more pneumatic features.

Sleep is a universal need for people. Sleep provides many physiological benefits, and a sound night's sleep is often desired by many. Unfortunately, some may not obtain good quality sleep, even when sufficient time and preparation for sleep is available. Having a bed appropriate for sleeping may allow for improved sleep. However, different people may sleep better with different bed characteristics, particularly characteristics that relate to the firmness of a mattress of the bed, and the support that mattress provides a sleeper. Complicating matters, even the same sleeper may sleep better with different mattress firmness, possibly in different areas of mattress, during the course of a single sleep session. As the sleeper may change sleep positions during the night, the sleeper may also benefit by having the mattress provide different support in different areas under the sleeper over the course of the sleep session.

It may be considered that as a sleep surface of the mattress provides the interface between the mattress and the sleeper, firmness of and support provided by the sleep surface may generally be considered the firmness and support provided by the mattress. With such a view, for this disclosure, the term "sleep surface firmness" is used to describe the firmness of and support provided by the sleep surface and the underlying support mechanism for the sleep surface provided by the mattress or bed. Sleep surface firmness may be changed in a variety of ways. One such way is to utilize air pressure to provide pneumatic adjustment of firmness of the sleep surface. The air pressure may be provided by an air pump, for example.

Operation of an air pump in close proximity to a sleep area may pose difficulties, however. The air pump may generate noise and/or vibrations during operation, noise and vibrations that may have a negative impact on quality and quantity of sleep. Space required for the air pump may also be in short supply in some sleep areas, necessitating consideration of placement of the air pump within a bed footprint. Locating the pump in the bed, however, may result in increased exposure of a sleeper to the noise and vibrations generated by the pump. Moreover, the bed may have an expected lifetime greater than that of the pump, decreasing utility of a combination bed and pump.

BRIEF SUMMARY OF THE INVENTION

Aspects of the invention provide a bed with a pneumatic system to provide for dynamic, configurable sleep surface firmness using an array of pumps. In some embodiments a bed includes an array of pumps for providing a pneumatic effect, with outputs of the array of pumps coupled together. In some embodiments each of the pumps of the array of pumps are independently operable. In some embodiments less than all of the pumps are operated to provide at least one predetermined pneumatic effect. In some embodiments operation of all of the pumps are required to provide at least one of the predetermined pneumatic effects, and operation of less than all of the pumps are required to provide others of the pneumatic effects. In some embodiments a controller determines which pumps of the array of pumps are operated to provide the at least one predetermined pneumatic effect. In some embodiments the controller determines that different pumps should be operated to provide the at least one pneumatic effect at different times. In some embodiments the controller maintains information as to a level of wear for each of the pumps. In some embodiments the controller determines which pumps to operate based on the information as to the level of wear for each pump. In some embodiments the outputs of the array of pumps are selectively coupled to at least one pneumatic chamber supporting a sleep surface of the bed. In some embodiments the outputs of the array of pumps are selectively coupled to any of a plurality of pneumatic chambers supporting a sleep surface of the bed. In some embodiments the pneumatic chambers comprise non-constant volume chambers. In some embodiments the pneumatic chambers comprise bladders. In some embodiments the pneumatic chambers comprise pneumatic cylinders. In some embodiments the outputs of the array of pumps are selectively coupled to the plurality of pneumatic chambers by valves for each of the chambers, or for each of a plurality of groups or subgroups of chambers. In some embodiments the valves are controlled by the controller. In some embodiments the controller determines an activation time for operation of the pumps to provide a predetermined pneumatic effect. In some embodiments the controller determines a voltage to be supplied to the pumps to provide a predetermined pneumatic effect. In some embodiments the controller determines an indication of wear of the pumps based on operating times and operating voltages of the pumps.

These and other aspects of the invention are more fully comprehended upon review of this disclosure.

DETAILED DESCRIPTION

Figure 1:
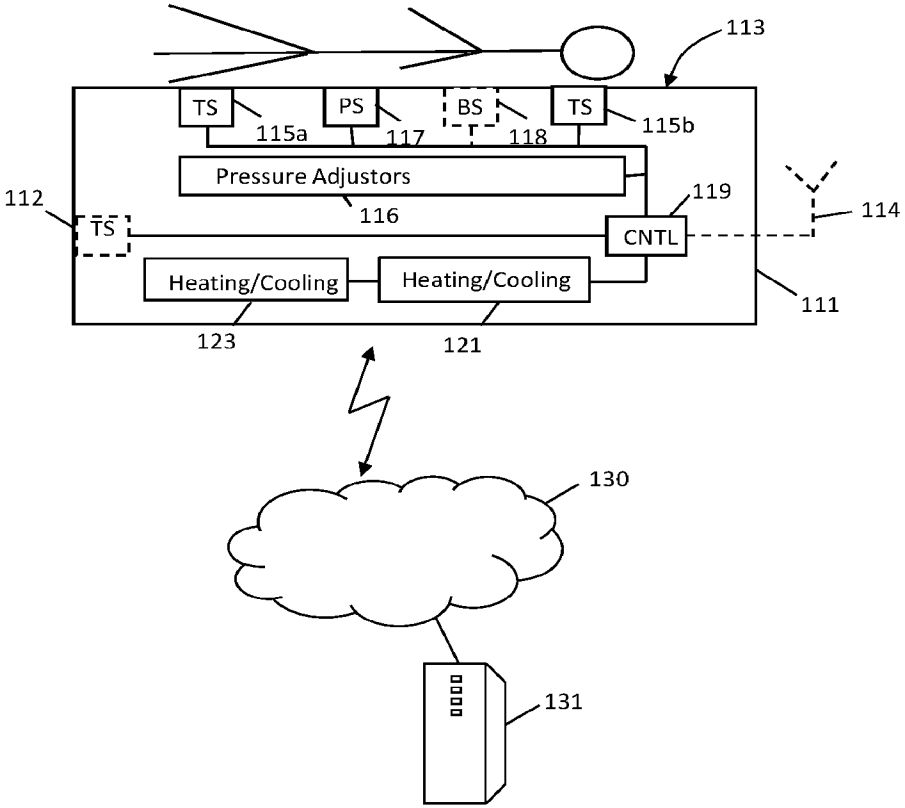
FIG. 1 is a semi-block diagram of a bed in accordance with aspects of the invention.

FIG. 1 is a semi-block diagram of a bed 111 in accordance with aspects of the invention. The bed of FIG. 1 includes a sleep surface 113 as an upper surface. In various embodiments, the sleep surface may be a top surface of a mattress, and in some embodiments the mattress, which itself may be comprised of multiple parts (separable or inseparable) may sit on top of a foundation. In some embodiments the bed may comprise the mattress, in some embodiments along with additional components relating to adjustment of firmness of the mattress. In some embodiments the mattress and foundation may be considered the bed. In various embodiments, however, the bed may include other parts, and in some embodiments the various parts may be combined into one or more separable or non-separable items. The bed of FIG. 1 may be generally rectangular parallelepiped in form, although other forms may instead be used, and in various embodiments may house a variety of components and materials and be comprised of multiple separable components and/or layers. Generally a user, or multiple users depending on the bed, sleeps on the sleep surface.

The bed includes a pressure adjustment component 116. The pressure adjustment component adjusts pressure of support(s), for the sleep surface. The supports may be pneumatic chambers, for example air bladders or pneumatic cylinders. Adjustment of pressure of the supports results in adjustment of the firmness and support provided by the sleep surface. The pressure adjustment component therefore provides pneumatic effects for the sleep surface, including adjustment of firmness of the sleep surface. The pressure adjustment component generally includes one or more air chambers, positioned close under the sleep surface, a plurality of pumps for providing air pressure to the air chambers through the valves, and, in some embodiments, a plurality of valves that control air flow into the chambers. Although generally shown as commonly located in the semi-block diagram of FIG. 1, in many embodiments the air chambers may lie close under the sleep surface, with the air pumps located farther from the sleep surface. In some embodiments multiple air chambers are used, spread across the bed, to allow for adjustment of firmness of different zones of the sleep surface. In various embodiments outputs of the pumps are provided to a common space, for example a common duct or tube, which feeds the air chambers. The pumps may be independently controlled, for example by a controller as discussed below. In some embodiments adjustment of firmness of the sleep surface, through adjustment of air pressure in the air chambers, may be accomplished through operating fewer than all of the plurality of pumps. In some such embodiments different ones of the pumps may be operated to adjust the firmness of the sleep surface at different times. In some embodiments pumps may be selected for operation, at any particular time, based on consideration of reducing wear over time for any particular pump.

In some embodiments the pressure adjustment component comprises an array of controllable chambers under the sleep surface of the bed. In some embodiments each of the controllable chambers or coils is individually adjustable, so as to provide a different level of firmness to different portions of the sleep surface of the bed. In some embodiments the controllable chambers or coils are adjustable in groups, so as to provide a different level of firmness to different portions of the sleep surface of the bed. With different portions of the sleep surface having different firmness, different levels of support or different sleeper support profiles may be provided.

The pressure sensors may be located under the sleep surface, and provide an indication of pressure on the sleep surface. Alternatively, the pressure sensors may be located in the air chambers, or anywhere along the pneumatic path that shares the same air pressure, such as the air tubes that connect to the air chamber, or at or near the valves that connect to the air chambers, underneath the sleep surface to measure the pressure in the air chambers. The air chambers can be same or different sizes, and they can form independent zones individually or in groups.

In some embodiments the controller commands the pressure adjustment component to change pressures at differing rates based on whether the sleeper is asleep, or based on a sleep stage of the sleeper. For example, as the sleeper changes sleep position or sleep stage, the controller may command the pressure adjustment component to change pressures in accordance with a sleep profile for the new sleep position or sleep stage. In such embodiments, the controller may command the pressure adjustment component to change pressures at slower rates for lighter sleep stages, for example sleep stages N1 and N2, than for deeper sleep stages, for example N3 and N4, or slow wave sleep.

The bed of FIG. 1 includes other components besides the pressure adjustment component for conditioning a sleep environment. For the example bed of FIG. 1, the components include a heating/cooling component 121 (and optional heating/cooling component 123). The heating/cooling component allows for adjustment of temperature of the sleep surface of the bed.

The components for conditioning the sleep environment are generally commanded to do so by a controller 119. In generating commands, the controller may do so using information from sensors, for example temperature sensors 115*a, b*, pressure sensors 117, and, in some embodiments, biometric sensors 118. Other sensors might include accelerometers, audio sensors, or infrared sensors. With respect to the pumps, the controller may also maintain an indication of prior usage of the pumps, for example a wear indicator for each of the pumps, and use that information in generating commands for the pumps as well. The controller also may make use of additional information, for example time-of-day information (for example maintained by the controller), information provided by users by way of user devices, and historical usage and/or sensor information maintained by the controller. As illustrated in FIG. 1, the controller is housed within the bed. In various embodiments the controller can be housed in either the mattress, base or be located externally outside of the bed. In some embodiments the controller comprises one or more processors. In some embodiments the controller is comprised of more than one processor, and the controller may be partitioned and housed in at least two separate physical enclosures, each with at least one processor. In some embodiments the controller is comprised of more than one processor, and the controller may be partitioned and housed in at least two separate physical enclosures, each with at least one processor. In some embodiments the controller is coupled to a network by way of wired or wireless communication circuitry, which may include for example antenna 114. In such embodiments the controller may be coupled (for example by a network 130 which may include the Internet) to a remote server 131, which in some embodiments may perform various of the functions ascribed to the controller herein.

The temperature sensors may be positioned in or adjacent the sleep surface, and provide an indication of a temperature of the sleep surface. In some embodiments, the temperature sensors are worn by the sleeper, provide an indication of a temperature of the sleeper's body or portion of body where the sensor is worn, and can be wired or wirelessly connected to the controller. The biometric sensors may be located in or under the sleep surface, and may provide an indication of heart rate, breathing information, or other biometric information regarding the user on the sleep surface. In some embodiments the biometric sensors may be in an article worn by the user, for example a shirt, with the biometric sensors wirelessly communicating with the controller. In some embodiments the biometric sensors are as discussed or part of an item as discussed in J. Kelly et al., Recent Developments in Home Sleep-Monitoring Devices, ISRN Neurology, vol. 2012, article ID 768794, the disclosure of which is incorporated herein for all purposes.

In some embodiments the controller uses the information from the biometric sensors to determine a sleep stage of the user. In some embodiments the sleep stage of the user may be considered to four stages of non-REM sleep—stages N1, N2, N3, N4, with stages N3 and N4 considered deep non-REM sleep or "slow-wave" sleep,—and one stage of REM sleep. In such embodiments, a user may be considered to typically undergo four full sleep cycles in a single night's sleep, with the first two sleep cycles being non-REM dominant and the last two sleep cycles being REM dominant. The sleep stage of the user may be determined using information from the biometric sensors, for example in manner utilizing or mimicking polysomnography techniques. In some embodiments the controller determines the sleep stage of the user by using one or more of its processors to compute the sleep stage based on information from the biometric sensors. In some embodiments, the controller communicates with a remote compute server over its communication interface, and the remote compute server computes the sleep stage based on biometric sensor information sent over the communication interface and may send sleep stage information back to the controller.

Figure 2:
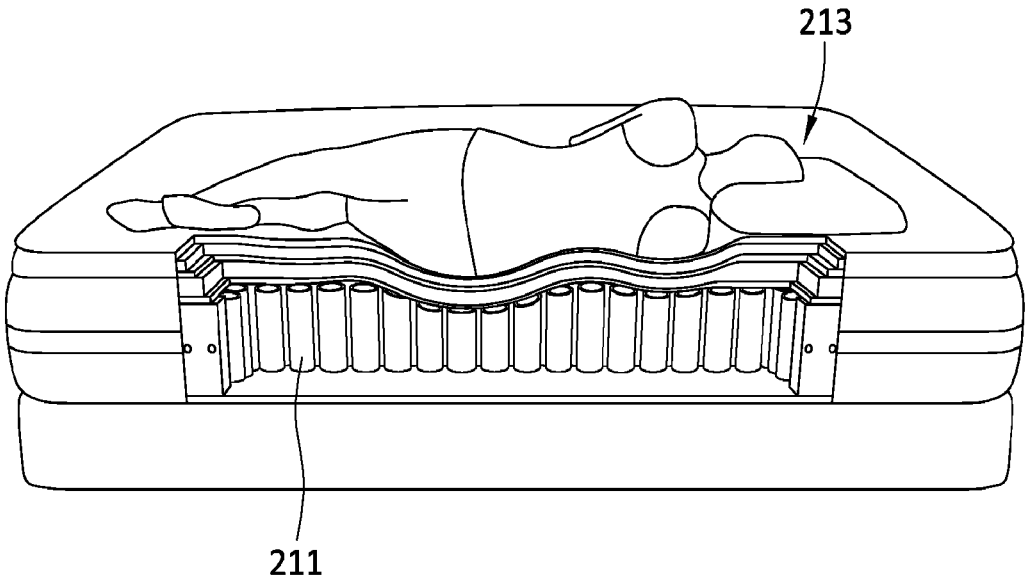
FIG. 2 is a semi-sectional side view of a bed in accordance with aspects of the invention, showing pressure adjustment cylinders holding chambers for adjusting firmness of the sleep surface.

FIG. 2 is a semi-sectional side view of a bed in accordance with aspects of the invention, showing pressure adjustment coil cylinders for adjusting firmness of the sleep surface. The bed of FIG. 2 includes a sleep surface 213 providing an upper surface for a sleeper to lie on. Cylinders 211, which may have an open top through which may extend air (or fluid in some embodiments) chambers housed partially within the cylinders, are underneath the sleep surface, and provide adjustable support for a sleeper on the sleep surface. Pressure of air in the chambers may be provided by an array of pumps (not shown in FIG. 2) housed within the bed. Control of the pump, generally along with control of associated valves, by a controller (not shown in FIG. 2) allows for control of pressure levels in the chambers, and hence control of firmness of the sleep surface and the support provided by the sleep surface for the sleeper.

Figure 3:
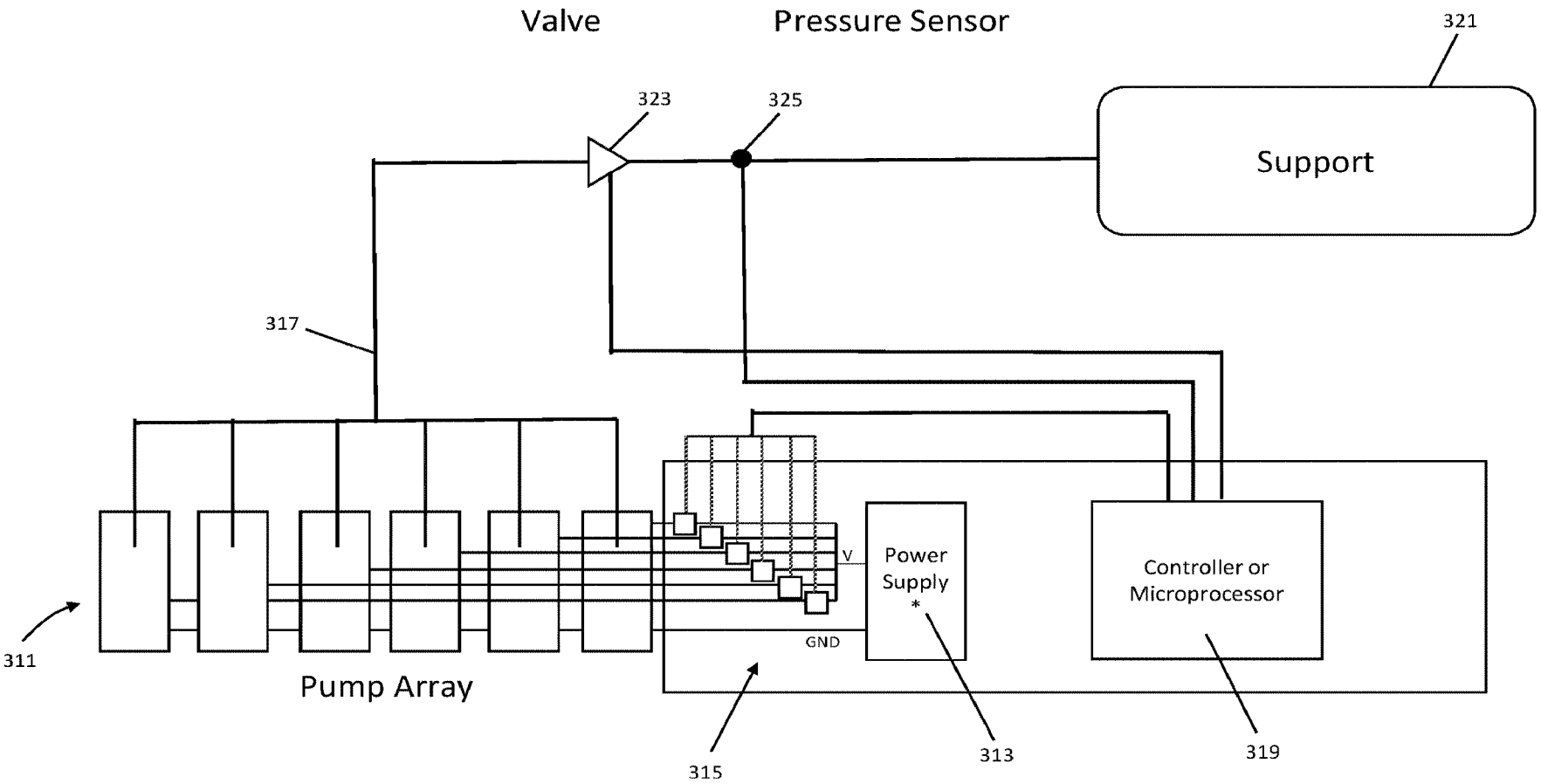
FIG. 3 is a system diagram of a pneumatics system for a bed in accordance with aspects of the invention.

FIG. 3 is a system diagram of a pneumatics system for a bed in accordance with aspects of the invention. In FIG. 3, a plurality of pumps 311, for example an array of pumps, provide pressurized air to a common manifold 317. The common manifold is coupled to an air chamber 321, which may comprise a plurality of air chambers in some embodiments. The common manifold may be coupled to the air chamber by way of an air supply tube or line. The air chamber provides support for a sleep surface of a bed, or a portion of the sleep surface. In some embodiments the air chamber lies below the sleep surface, with firmness of the sleep surface varying with pressure of air in the air chamber. In some embodiments the pumps may be more distal from the sleep surface than the air chamber, and/or distal from a head of the bed, for example in a foot of the mattress providing the sleep surface, and in some embodiments the pumps may be located in a bottom of a frame of the bed.

The air supply tube is shown in FIG. 3 as including a valve 323. In some embodiments a first tube may couple the common manifold to the valve, and a second tube may couple the valve to the chamber. With the valve open, air from the pumps may be provided to the air chamber. With the valve closed, air in the air chamber may be prevented from escaping from the air chamber. In some embodiments the valve may be a three-way valve, with a third valve position allowing air from the air chamber to escape to the atmosphere, without applying back pressure to the pumps, or a four-way valve, also allowing air from the common outlet to be vented to the atmosphere without decreasing air pressure in the air chamber. In various embodiments additional valves may be provided. For example, other valves, which may be check valves, may be provided about outlets of each pump, to prevent back pressure to those pumps when not in operation, or when not operating sufficiently to avoid back pressure.

A controller 319 controls operation of the pumps, and, in some embodiments, operation of the valve. The controller may be in the form of one or more processors, configured by program instructions to provide for control of the pumps and the valve. The controller receives an indication of air pressure in the air chamber from a pressure sensor 325. The pressure sensor is shown in FIG. 3 as sensing air pressure in the air supply tube between the valve and the air chamber. In various embodiments the pressure sensor may be located at the air chamber, or in the valve. The controller may also receive other information from other sensors, for example the sensors discussed with respect to FIG. 1, or from other controllers or processors. The controller may also determine a desired pressure level for the air chamber, with the desired pressure level possibly changing over time, including over the time of a single sleep session. In some embodiments the controller may also determine a desired time to effect a change in the pressure level for the air chamber. For example, in some embodiments the controller may command slower or faster modifications in the pressure level based on a sleep stage of a sleeper on the sleep surface, or whether the sleeper is asleep, or is to be awakened.

In the embodiment of FIG. 3 the controller controls operation of the pumps through control of power, for example voltage, supplied to the pumps. For FIG. 3 this is illustrated with a power supply 313 providing power to the pumps, with the power to each pump gated by switches 315, with a switch for each pump, controlled by controller. In various embodiments the switches may instead be power regulation circuits, with the controller indicating a commanded voltage level to each of the power regulation circuits, with the power regulation circuits providing the commanded voltage to the pumps, on a pump-by-pump basis. In such embodiments, for example, the power supply may convert AC power to DC power at a first voltage level, with the power regulation circuits regulating voltage supplied to the pumps. As the commanded voltage indicated by controller may be zero or some other level, the controller may utilize the commanded voltage both to turn on and off the pumps and to also set nominal output pressure of the pumps.

In some embodiments not all of the pumps need be or are operated at the same time, for at least some of the pressure modifications determined by the controller. In some such embodiments, however, operation of all of the pumps may be necessary to provide one or more, but not all, pressure modifications determined by the controller. For example, pressure modifications to provide a "wave" effect to help relax an awake sleeper may require utilization of all of the pumps simultaneously, while a slower pressure modification to adjust for change in position of an asleep sleeper may only require utilization of a single pump, or only some of the available pumps. Thus, some embodiments the controller may select only a single pump for operation, and in some embodiments the controller may select only a subset of the pumps for operation. In such embodiments the controller may select different pumps or different subsets of pumps for operation at different times. In such embodiments the controller may select different pumps or different subsets of pumps for operation depending on the specific sleep stage or body position of the sleeper. In some such embodiments the controller may select different pumps or different subsets of pumps for operation for different pressure modifications determined by the controller, or for different pressure modification events. In some embodiments the controller may select pumps for operation on a basis expected to result in reduced wear over time for any particular pump of the array of pumps. In some embodiments the controller may select pumps for operation on a sequential basis. In some embodiments the controller may select pumps on a round robin basis.

In various embodiments the controller maintains information regarding pump usage. For example, in some embodiments, for each pump, the controller maintains information relating to an amount of time each pump was operated, and a voltage at which the pump was operated. In some embodiments the information is maintained as a numeric value. As pump wear may be related to an amount of time the pump was operated, and at what power levels, the numeric value may be considered a pump wear value. In some embodiments the pump wear value may be related to, based on, or compared with a numeric value indicating an expected operational lifetime for each pump. In some embodiments the controller may be programmed with an initial value indicating an expected remaining lifetime for a pump, with the controller subtracting a wear value from that value, after pump operation, to indicate a revised expected remaining lifetime for the pump. In various embodiments the controller may select a pump or a subset of pumps for operation based on the expected remaining lifetime for the pump.

The controller may also control operation of the valve. For example, in various embodiments the controller may open the valve during pump operation, to allow for increasing air pressure in the chamber, or close the valve, so as to retain pressure in the air chamber without providing possibly unwanted back pressure to the pumps when the pumps are not in operation. In some embodiments, the control of the valve opening may be analog in nature, and an analog voltage applied the valve may control the size of the opening, where the analog voltage is derived from a digital control from the controller via a conversion device such as a digital-to-analog converter.

Figure 4:
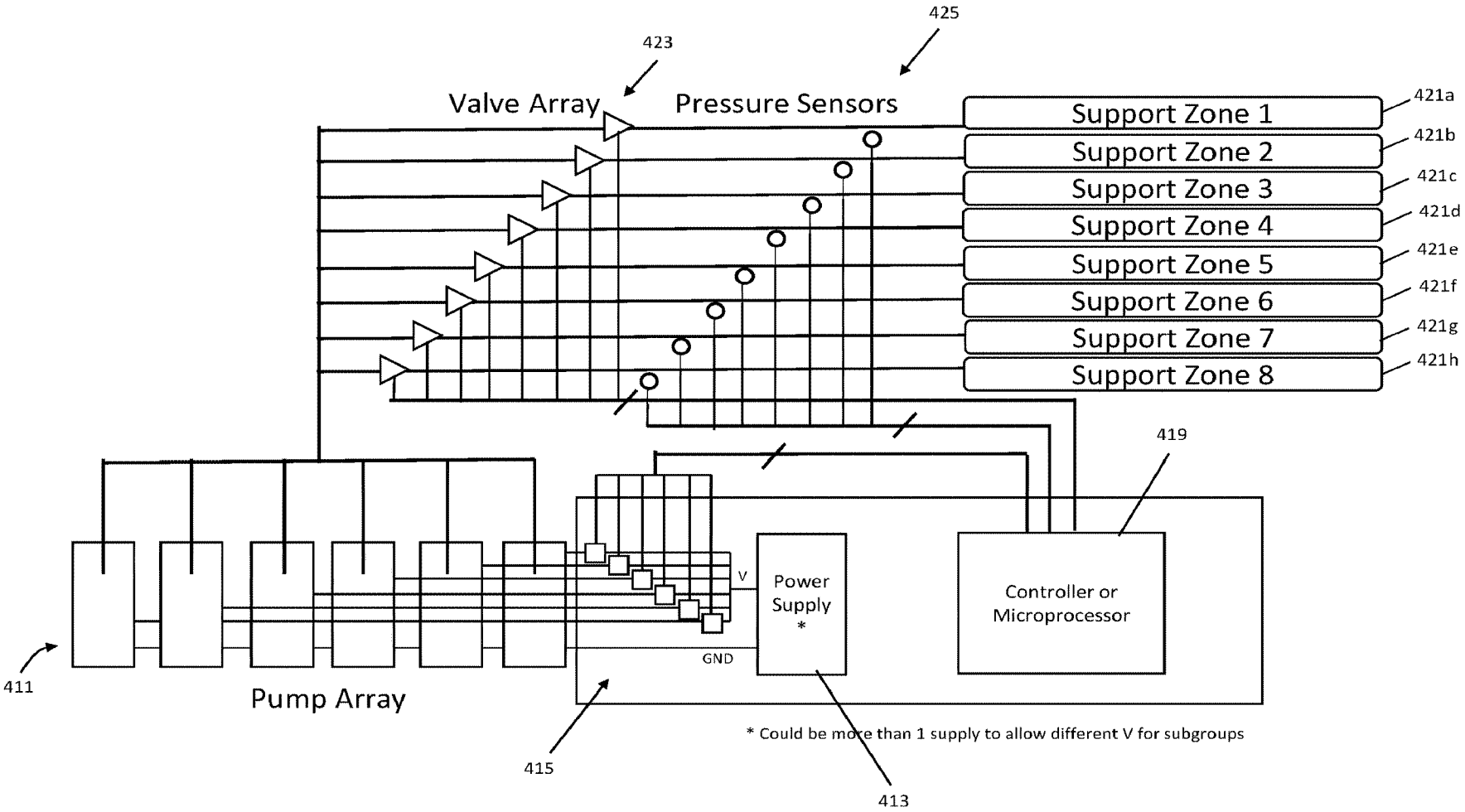
FIG. 4 is a system diagram of a further pneumatics system for a bed in accordance with aspects of the invention.

FIG. 4 is a system diagram of a further pneumatics system for a bed in accordance with aspects of the invention. The further pneumatics system of FIG. 4 provides for independent adjustment of pressure for multiple different zones of chambers supporting a sleep surface. Thus, while the system of FIG. 3 shows a single air supply line leading to a single support, which may be comprised of multiple chambers, the system of FIG. 4 includes a plurality of air supply lines each leading to one of a plurality of corresponding supports, which may also be comprised of multiple chambers. Each of the corresponding supports which in total may be considered an array of supports, may provide support for a sleep surface in different areas or zones.

The further pneumatics system of FIG. 4 is similar to the pneumatics system of FIG. 3, other than the further pneumatics system of FIG. 4 having arrays of air chambers, arranged in zones 421*a-h*, with corresponding arrays of valves 423 and pressure sensors 425 for each zone. Like the system of FIG. 3, the system of FIG. 4 includes an array of pumps 411, with outputs of the pumps provided to a common manifold. The pumps are selected for activation by a controller 419. The controller may be configured to operate in the same way as the controller of FIG. 3, other than for aspects relating to the array of supports and corresponding arrays of valves and pressure sensors. Similarly, the further pneumatics system includes a power supply 413, with power regulation circuits 415 providing power levels to the array of pumps as discussed with respect to FIG. 3.

In operation, the controller may command activation of pumps and opening and closing of different valves so as to provide air chambers of each of the different zones with different pressures. Moreover, with the use of different zones, different portions of a sleep surface may provide different levels of firmness, allowing for increased variation in support provided to a sleeper by the sleep surface.

Figure 5:
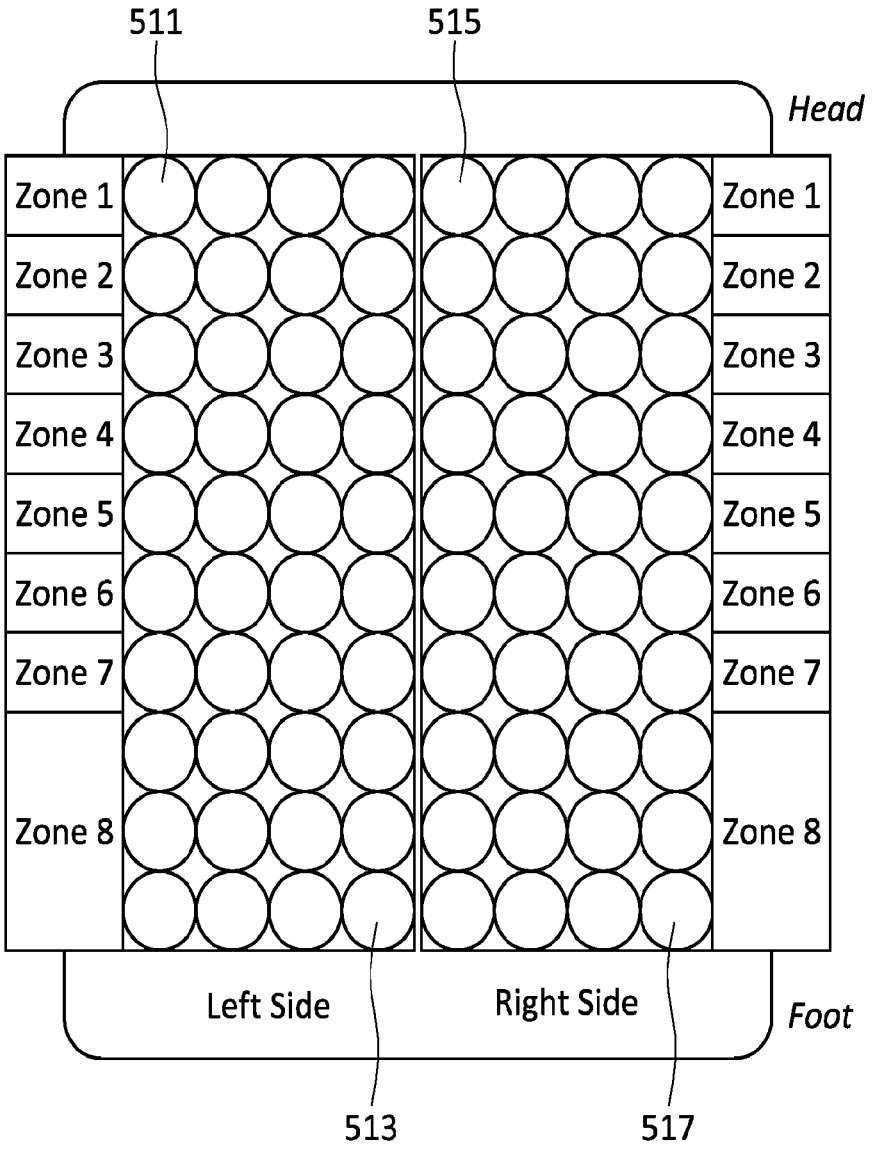
FIG. 5 is a semi-block diagram top view of pressure adjustment chambers locations of a bed with multiple zones in accordance with aspects of the invention.

The further pneumatics system may be used, for example with the bed of FIG. 5. More commonly, perhaps, the further pneumatics system may be used for one side of the bed of FIG. 5, with another identical pneumatics system used for the other side of the bed of FIG. 5.

FIG. 5 is a semi-block diagram top view of pressure adjustment chambers locations of a bed with multiple zones in accordance with aspects of the invention. The bed includes a left side and a right side. Generally each side is sized to accommodate a sleeper. The bed also includes what may be termed a head of the bed, stretching across a first end of the left and right sides, with a foot of the bed at a second end, opposite the first end. Sleepers will generally position their heads toward the head of the bed, with their feet towards the foot of the bed.

The bed includes an array of pressure adjustment chambers. For the bed of FIG. 5, the array includes 80 chambers, arranged in a 10×8 array. In some embodiments each of the 80 chambers may be individually adjusted. For example, in some embodiments, pressure in each chamber or a group of chambers may be individually regulated, for example as commanded by the controller of FIG. 1, 3 or 4. In some embodiments the array of pressure adjustment chambers may be considered as including two sub-arrays. For example, a first sub-array may include chambers 511-513 on a left side of the bed, and a second sub-array may include chambers 515-517 on a right side of the bed.

In some embodiments a pressure fabric or mat or the like may be used to provide pressure indications to a controller. In some embodiments a pressure sensor is associated with each of the chambers. In such embodiments, the controller may receive an indication of pressure on the sleep surface about the location of each of the chambers. In some such embodiments the pressure sensor is positioned in the bed between the chamber and a sleep surface of the bed. In other of some such embodiments, the pressure sensor is associated with an air valve of a chamber or group of chambers.

In some embodiments a pressure sensor is associated with a plurality of chambers. For example, in the embodiment of FIG. 5, a first pressure sensor may be associated with a portion of a row of chambers closest to the head and on the left side of the bed, a second pressure sensor may be associated with a portion of the row of closest to the head and on the right side of the bed, and so on for each row of chambers. Alternatively, some (or all) of the pressure sensors may be associated with chambers of multiple rows. For example, in FIG. 5, a single pressure sensor may be provided for 16 zones, with eight zones on the left side of the bed and eight zones on the right side of the bed, each zone, other than zones closest to the foot of the bed, being for a single row of chambers, with the zones closest to the foot of the bed being for three rows of chambers.

Figure 6:
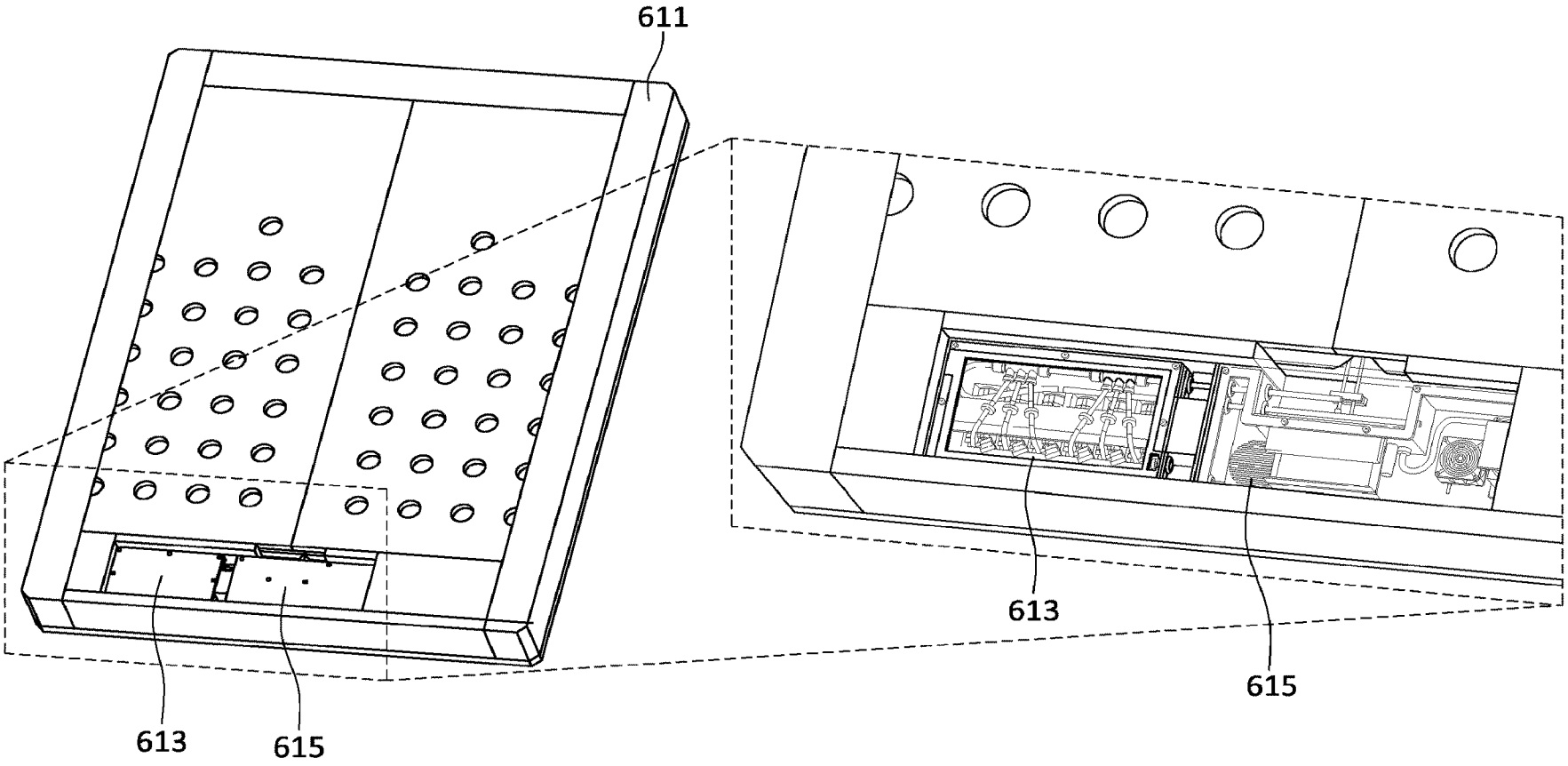
FIG. 6 illustrates a bed assembly including an array of pumps in accordance with aspects of the invention.

FIG. 6 illustrates a mattress 611 for a bed including an array of pumps in accordance with aspects of the invention. In most embodiments the mattress includes one or more air chambers. In some embodiments, the top mattress includes a compartment housing a pump box 613 and a pneumatics box 615. The pump box 613 includes a plurality of pumps, for example an array of pumps. The pneumatics box receives air from the pump box and includes the controller and valves that connect to the air chambers and the pump box 613. In the embodiment of FIG. 6 the pneumatic box and the pump box are located at what may be considered a foot of the mattress, although the pump and pneumatic boxes may be located elsewhere in various embodiments. In some embodiments the pump and pneumatic boxes can be housed in a single housing.

Figure 7:
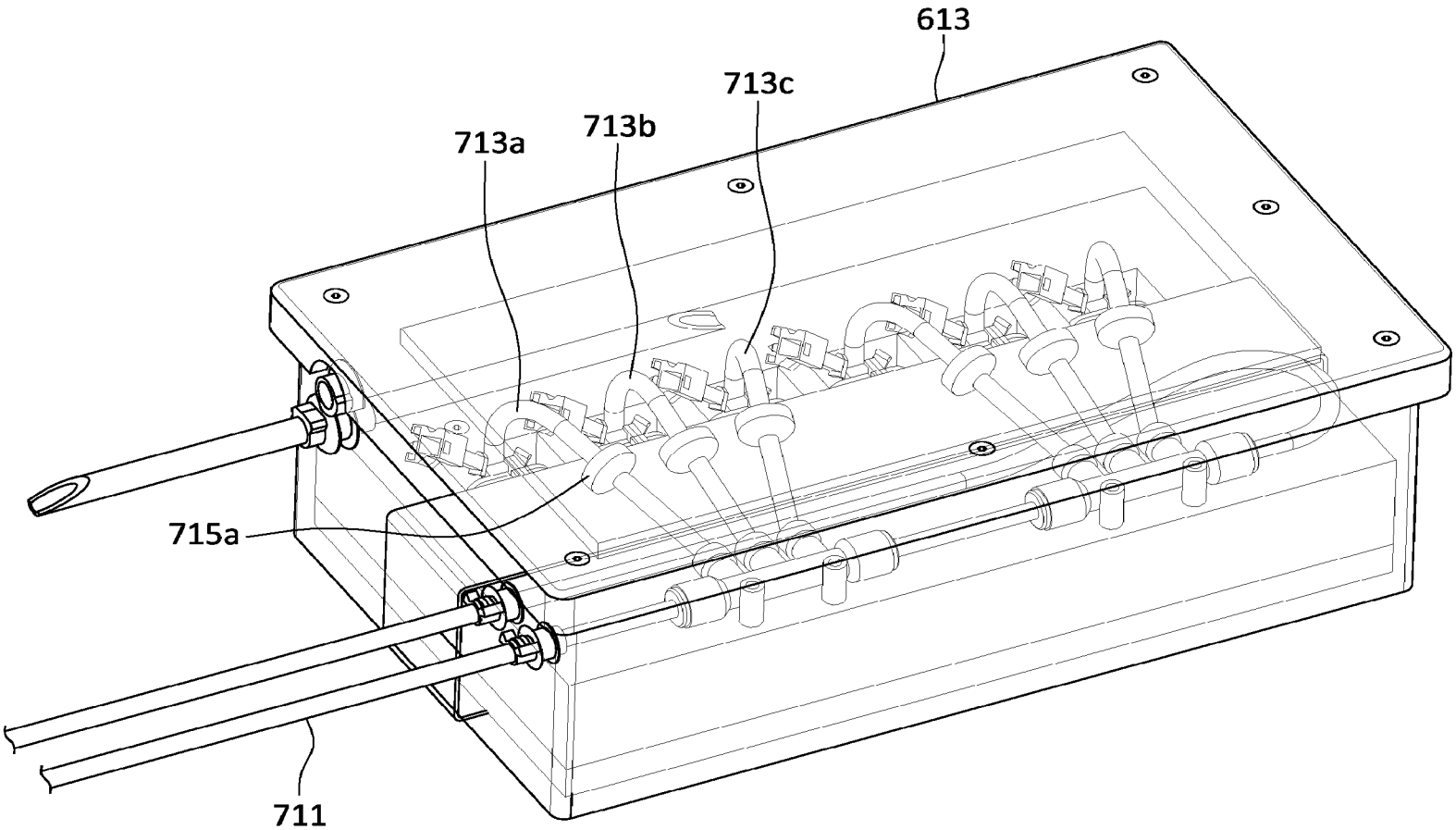
FIG. 7 illustrates a pump box for an array of pumps in accordance with aspects of the invention.

FIG. 7 illustrates a pump box for an array of pumps in accordance with aspects of the invention. The pump box of FIG. 7 may be, for example, the pump box 613 of FIG. 6. For purposes of description, the pump box of FIG. 7 is shown with a partially transparent top. The pump box includes a plurality of pumps, with for example pumps 713*a-c* being labeled in the figure. Outputs of the pumps are coupled to a common output line 711. The common output line may be part of or lead to a common manifold, which may be partly or wholly in a pneumatics box, for example the pneumatics box of FIG. 6 or FIG. 8. In some embodiments, and as illustrated in FIG. 7, a check valve is provided between each pump and the common output line. For example, check valve 715*a* is provided between the output of pump 713*a* and the common output line. The check valve serves to prevent air flowing from the common output line back to the pump.

Figure 8:
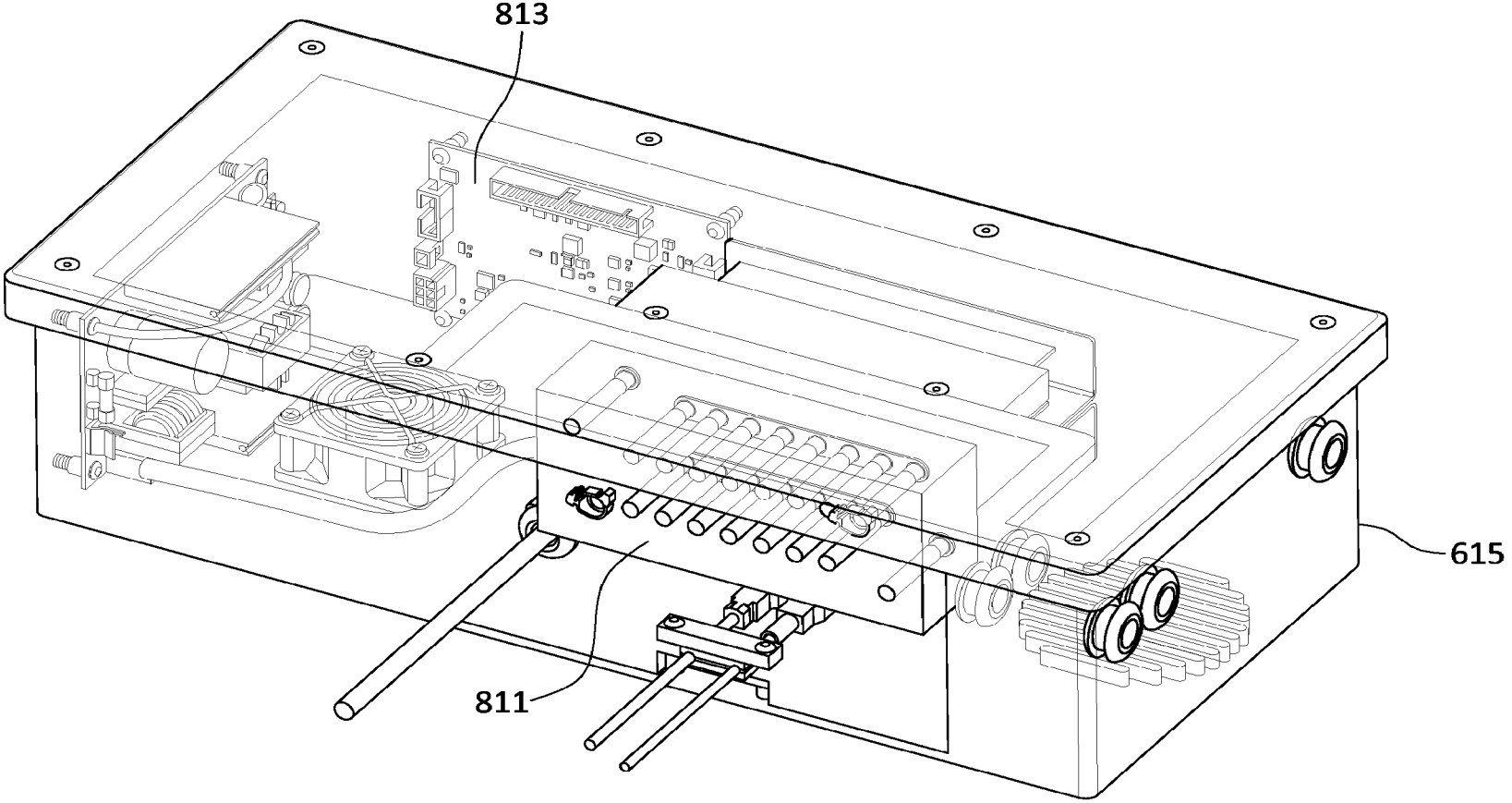
FIG. 8 illustrates a pneumatics box that includes the controller and valve assembly, that connects to a pump box for an array of pumps in accordance with aspects of the invention.

FIG. 8 illustrates a pneumatics box in accordance with aspects of the invention. The pneumatics box may be the pneumatics box 615 of FIG. 6 in some embodiments. A valve assembly 811 holding an array of valves is within the pneumatics box. The array of valves couples a common manifold of the pneumatic box to output lines, to provide pressurized air to chambers of a mattress. The array of valves may be the array of valves discussed with respect to FIG. 4 or elsewhere herein. A circuit board 813 is also within the pneumatics box. In some embodiments the circuit board includes power regulation circuitry for regulating power of a power supply, which also may be included in the pneumatics box in some embodiments. In some embodiments the circuit board may also include a controller, for example the controller of FIG. 3 or 4 or as elsewhere discussed herein. In some embodiments, however, the controller may be housed elsewhere within the bed, with the circuit board including interface circuitry for receiving signals from the controller and providing signals to the controller.

Figure 9:
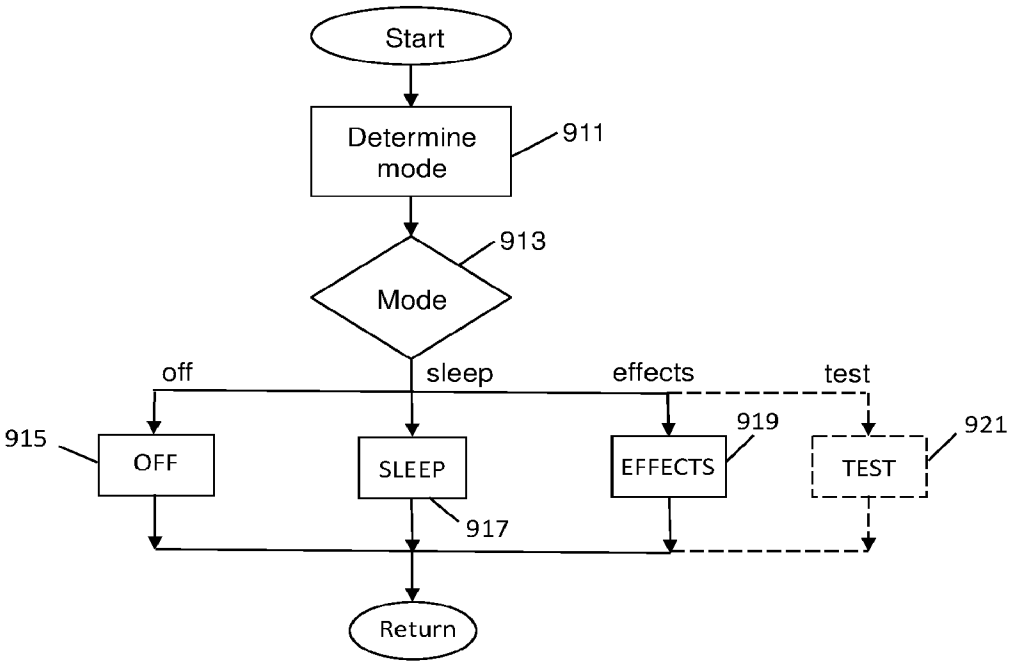
FIG. 9 is a flow diagram of a process for determining an operating mode that may be used in operation of an array of pumps for a bed, in accordance with aspects of the invention.

FIG. 9 is a flow diagram of a process for determining an operating mode that may be used in operation of an array of pumps for a bed, in accordance with aspects of the invention. In some embodiments the process is performed by a bed, for example the bed of FIG. 1. In some embodiments the process is performed by a controller, for example the controller of FIG. 1 or FIG. 3 or FIG. 4. In some embodiments the process is performed by a processor, for example configured by program instructions.

In block 911 the process determines a mode for the bed. In some embodiments the process determines a mode for a pneumatic system of the bed. In some embodiments the process determines the mode based on one, some, or all of a time of day, a day of the week, a presence of a user on a sleep surface of the bed, and/or a sleep stage of the user on the sleep surface of the bed. In some embodiments the modes include an off mode, an effects mode, a sleep mode, and a test mode. In some embodiments the modes may further include a pre-entry mode and a wake-up mode, and possibly still other modes. In some embodiments the process determines the mode to be the off mode if there is no user in the bed, and the pneumatics system is not in the test mode. In some embodiments the process determines the mode to be the effects mode if the user is in the bed but not asleep. In some embodiments the process determines the mode to be the sleep mode if the user is in the bed and asleep.

In block 913 the process selects mode operations to execute.

If in off mode, the process continues to block 915 and turns off pneumatics operations.

If in sleep mode, the process continues to block 917 and executes pneumatics operations appropriate for a user sleeping on the sleep surface. In some embodiments the pneumatics operations for sleep mode including varying pressure of the sleep surface based on predetermined information regarding sleep surface firmness and expected quality of user sleep. In some embodiments desired sleep surface firmness may vary based on a sleep stage of the user, as determined, for example, using biometric sensors of the bed. In various embodiments, during sleep mode, a rate of change of firmness of the sleep surface, or a rate of change of pressure in air chambers for the sleep surface, is limited to below a predetermined rate, or set to a predetermined rate. In various embodiments the predetermined rate of change of pressure in the air chambers is a rate of change less than may be provided by an array of pumps of the bed. In some embodiments the predetermined rate of change of pressure in the air chambers is a rate of change less than may be provided by 80% of the pumps of an array of pumps of the bed. In some embodiments the predetermined rate of change of pressure in the air chambers is a rate of change less than may be provided by 60% of the pumps of an array of pumps of the bed. In some embodiments, the number and/or the speed of pumps enabled and the duration and/or size of the valve opening depend on the specific sleep stage of the sleeping user.

If in effects mode, the process continues to block 919 and executes pneumatics operations appropriate for a user on the sleep surface while the user is awake. In some embodiments, these effects require faster movement of the air chambers relative the slower, quieter movements required during sleep. In some embodiments the pneumatics operations include providing sleep surface firmness variations expected to aid a user trying to sleep, or to wake a sleeping user at a wake time. In some embodiments, the number and/or the speed of pumps enabled and the duration and/or size of the valve opening depend on the movement effects required to help relax the user or demonstrate the support changes that are possible.

If in test mode, the process continues to block 921 and executes pneumatics operations to test status of the pumps and valves. The pneumatics operations may include sequentially operating each pump and/or valve, and determining, for example based on a pressure sensor associated with one or more air chambers, whether an expected increase or decrease in air pressure has occurred due to operation of the pump and valve.

The process thereafter returns.

Figure 10:
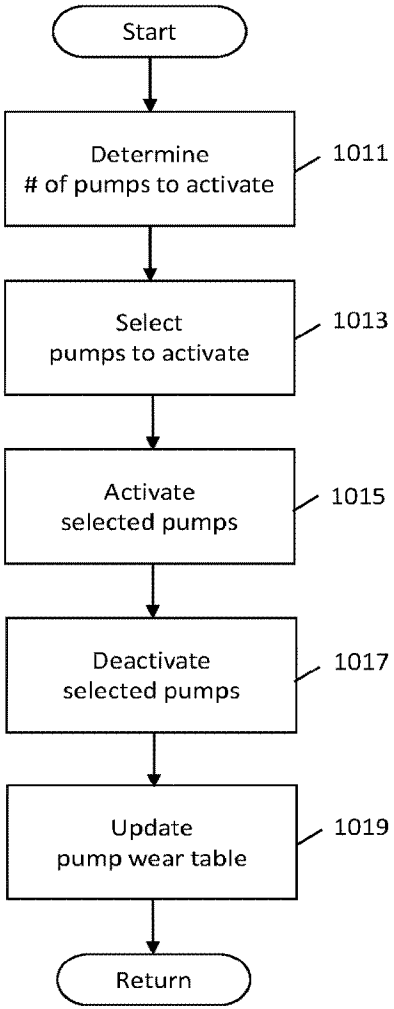
FIG. 10 is a flow diagram of a process for operating pumps in an array of pumps, in accordance with aspects of the invention.

FIG. 10 is a flow diagram of a process for operating pumps in an array of pumps, in accordance with aspects of the invention. In some embodiments the process is performed by a bed, for example the bed of FIG. 1. In some embodiments the process is performed by a pneumatics system, for example the pneumatics system of FIG. 3 or 4. In some embodiments the process is performed by a controller, for example the controller of FIG. 1, 3, or 4. In some embodiments the process is performed by a processor, for example configured by program instructions.

In block 1011 the process determines a number of pumps to activate. In some embodiments the process determines a number of pumps to activate based on a mode of the bed, or a mode of a pneumatics system of the bed. In some embodiments the process determines a number of pumps to activate that is less than a total number of pumps of the bed. In some embodiments the process determines a number of pumps to activate that is less than a total number of pumps of the bed only if the mode of the bed, or the mode of the pneumatics system of the bed, is a sleep mode. In some embodiments the process determines a number of pumps to activate based on a desired maximum pressure of an air chamber of the bed and a desired maximum rate of change in air pressure of the air chamber. In some such embodiments, the desired maximum pressure and the desired maximum rate of change in air pressure may be achieved using less than all of the pumps of the bed.

In some embodiments the process also determines a power level at which to operate the pumps to be activated. In some embodiments the determined power levels may be different for different ones of the pumps to be activated. In some embodiments the determined power levels are based, at least in part, on a desired operating rate for a pump. In some embodiments the desired operating rate for the pump is based on a mode of the bed, or the pneumatics system. For example, in sleep mode the operating rate for the pump may be limited to predetermined rate, to for example avoid generating excessive noise for a sleep environment.

In block 1013 the process selects the pumps of an array of pumps to be activated. Generally, the number of pumps to be activated is determined in block 811, and which of the available pumps to be activated in determined in block 813. In some embodiments the process selects which pumps to be activated on a sequential basis. For example, if there are 8 pumps, which may be considered pumps a-h, and 3 pumps are to be activated, for a first activation event pumps a-c may be activated, for a second activation event pumps d-f may be activated, for a third activation event pumps g, h, and a may be activated, and so on. In some embodiments pumps may be selected for activation on a round robin basis, with possibly pumps operated for only a maximum continuous period of time before other pumps are activated instead. In some embodiments pumps may be selected for activation on a random basis. In some embodiments pumps may be selected for activation based on a wear value associated with each pump. For example, pumps with wear values indicating the least wear may be selected for activation.

In block 1015 the process activates the selected pumps. In some embodiments the pumps are activated at the selected voltages. In some embodiments the pumps are activated until the air chambers, or particular ones of the air chambers, reach a determined pressure. In some embodiments the pumps are activated for a predetermined time, which in some embodiments may vary based on a desired air chamber pressure and an air chamber pressure prior to pump activation. In some embodiments the controller may also open a valve to the air chambers, or particular valves to particular ones of the air chambers, in conjunction with activating the selected pumps.

In block 1017 the process deactivates the activated pumps. In some embodiments the process deactivates the pumps when the air chambers have reached a desired pressure. In some embodiments the pump deactivates the pumps after lapse of a predetermined period of time after activation of the pumps.

In block 1019 the process updates wear values for the activated pumps. In some embodiments the wear values are updated based on a duration of activation and power of activation for each of the pumps. In some embodiments the process maintains information relating duration of activation and power of activation for the pumps to expected lifetime of the pumps. In some embodiments the process updates the wear values to indicate an expected remaining lifetime of the pumps.

The process thereafter returns.

Figure 11:
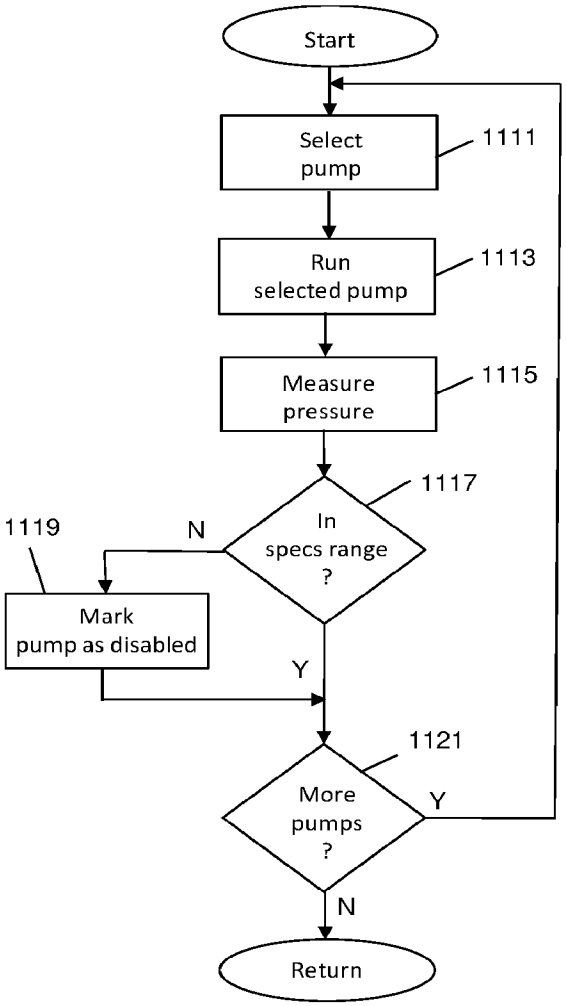
FIG. 11 is a flow diagram of a process for testing pumps in an array of pumps, in accordance with aspects of the invention.

FIG. 11 is a flow diagram of a process for testing pumps in an array of pumps, in accordance with aspects of the invention. In some embodiments the process is performed on a periodic basis, for example once every week or once every month. In some embodiments the process is performed after a predetermined number of activation events. In some embodiments the process is performed by a bed, for example the bed of FIG. 1. In some embodiments the process is performed by a pneumatics system, for example the pneumatics system of FIG. 3 or 4. In some embodiments the process is performed by a controller, for example the controller of FIG. 1, 3, or 4. In some embodiments the process is performed by a processor, for example configured by program instructions.

In block 1111 the process selects a pump for testing. In some embodiments pumps of an array of pumps are selected sequentially.

In block 1113 the process runs, or activates, the selected pump. In some embodiments the selected pump is run for a predetermined period of time at a predetermined power level. In some embodiments a valve to a selected air chamber, or a plurality of selected air chambers, is also opened, so that the pump may increase pressure of the air chamber.

In block 1115 the process determines a measure of pressure of the selected air chamber. In some embodiments the measure of pressure is provide by a pressure sensor for the selected air chamber. In some embodiments the process determines a measure of change of pressure of the selected air chamber between a time prior to running of the selected pump and a time after running of the selected pump.

In block 1117 the process determines if the measure of pressure of the selected air chamber is within a predetermined range of an expected pressure of the selected air chamber. For example, running of the pump for the predetermined time and at the predetermined power may be expected to increase pressure of the air chamber by 15% (or some other amount), plus or minus 3% (or some other amount). If the measure of pressure is within the predetermined range, the process proceed to block 1121.

If the measure of pressure is not within the predetermined range of the expected pressure, the process goes to block 1119. In block 119 the process marks the selected pump as failed. In some embodiments pumps marked as failed are no longer use for pneumatic operations. The process then continues to block 1121.

In block 1121 the process determines if pumps remain to be tested. If so, the process goes to block 1111. Otherwise the process returns.

Although the invention has been discussed with respect to various embodiments, it should be recognized that the invention comprises the novel and non-obvious claims supported by this disclosure.

What is claimed is:

1. A bed, comprising:

a sleep surface;

an array of pumps for providing a pneumatic effect for the sleep surface, with outputs of the array of pumps coupled together, each of the pumps of the array of pumps independently operable and less than all of the pumps may be operated to provide at least one predetermined pneumatic effect;

a controller configured to determine which pumps of the array of pumps are to be operated to provide the at least one predetermined pneumatic effect, the controller configured: to determine that different pumps should be operated to provide the at least one pneumatic effect at different times, to determine that different pumps should be operated to provide the at least one pneumatic effect at different times, to maintain information as to a level of wear for each of the pumps, and to determine which pumps to operate based on the information as to the level of wear for each pump;

wherein the controller is configured to determine the indication of wear of the pumps based on operating times and operating voltages of the pumps.

2. The bed of claim 1, wherein outputs of the array of pumps are selectively couplable to at least one chamber supporting the sleep surface.

3. The bed of claim 1, wherein the outputs of the array of pumps are selectively coupled to any of a plurality of chambers supporting a sleep surface of the bed.

4. The bed of claim 1, wherein the controller is configured to determine an activation time for operation of the pumps to provide the predetermined pneumatic effect.

5. The bed of claim 4, wherein the controller is configured to determine a voltage to be supplied to the pumps to provide the predetermined pneumatic effect.

* * * * *